United States Patent [19]

Ek

[11] 4,123,995

[45] Nov. 7, 1978

[54] HOT WATER OR STEAM BOILER

[75] Inventor: Finn U. Ek, Osby, Sweden

[73] Assignee: Osby, Varme AB, Sweden

[21] Appl. No.: 777,676

[22] Filed: Mar. 15, 1977

[30] Foreign Application Priority Data

Apr. 1, 1976 [SE] Sweden ..... 7603764

[51] Int. Cl.[2] ..... F22B 11/02

[52] U.S. Cl. ..... 122/43; 122/235 R

[58] Field of Search ..... 122/1 R, 42, 43, 235 R, 122/235 A, 332, 333, 336, 348

[56] References Cited

U.S. PATENT DOCUMENTS

| | | | |
|---|---|---|---|
| 811,785 | 2/1906 | Meurisse | 122/43 |
| 2,038,580 | 4/1936 | LaMont | 122/1 |
| 3,012,548 | 12/1961 | Guszmann | 122/235 |
| 3,918,410 | 11/1975 | Backman | 122/348 |

FOREIGN PATENT DOCUMENTS

| | | | |
|---|---|---|---|
| 637,574 | 1/1928 | France | 122/235 |

*Primary Examiner*—Kenneth W. Sprague

[57] ABSTRACT

Hot water or steam boiler comprising a furnace section and a convection section in which the furnace section is limited by a wall section formed of liquid or steam tubes placed side by side, while the convection section has a number of liquid or steam chambers communicating with said liquid or steam tubes, through the which chambers there run flue gas tubes communicating with said furnace section through flue gas chambers and sealed off from the fluid or steam chamber.

8 Claims, 4 Drawing Figures

HOT WATER OR STEAM BOILER

Figure 1:
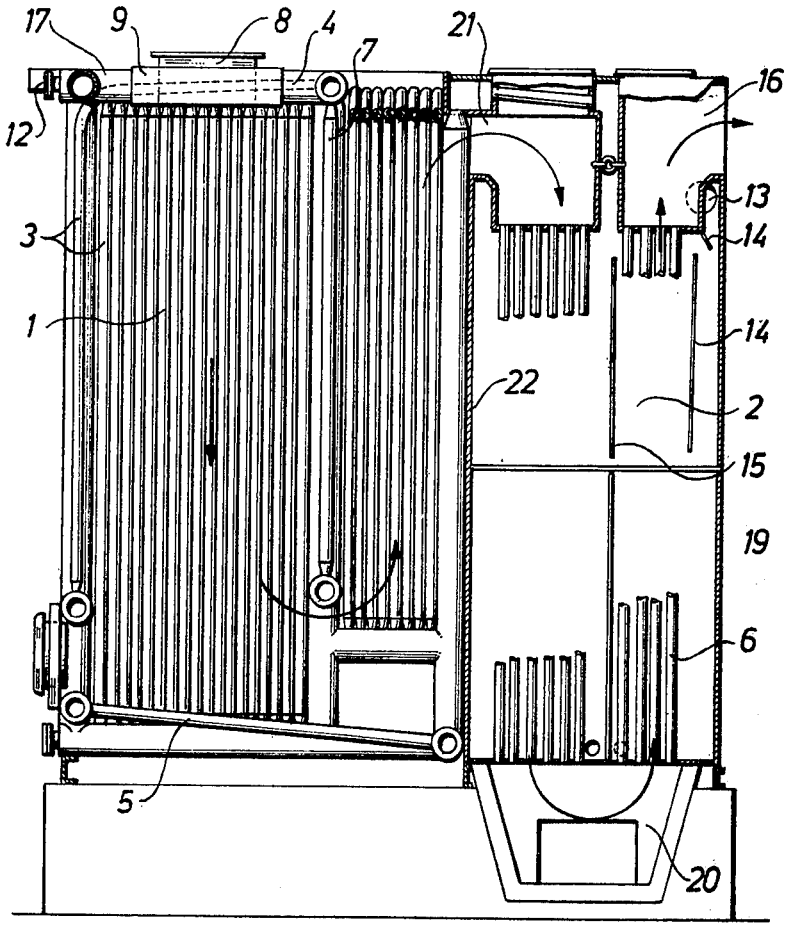

The invention relates to a hot water or steam boiler containing a furnace section and a convection section. The object of the furnace section is generally to burn the fuel or at least to after-burn the fire gases from a preheater, whereas the convection section is intended to make use, at a lower temperature, of the surplus heat in the flue gases led off to the chimney.

Such boilers can work with different heat-bearing media, e.g. warm or hot water, steam, hot oil, etc. Known boiler constructions working on these principles have had the form either of water tube boilers with water tubes both in the furnace and the convection section or with the furnace having plane or cylindrical double walls, between which the heat-bearing medium is contained, and the convection section having plane double walls which contain the heat-bearing medium and around which the flue gases flow in an essentially flexuous path.

The disadvantage of boilers of these kinds is that boilers in which the furnace is surrounded by plane double walls containing the heat-bearing medium between them are exposed in operation to considerable movements due to thermal expansion in the material, at least in the furnace section, the which movements readily cause breakage, whereas boilers having tubes for the heat-absorbing medium both in the furnace and the convection sections are expensive to manufacture, at the same time as the convection section is difficult of access for overhaul and sweeping.

The attempt has been made to brace the plane walls in boilers of the former kind with stays holding the double walls together, but the stays as well show a tendency to break owing to the thermal movements in the plane furnace walls.

The present invention has as its object to avoid the said disadvantages and consists essentially in the limitation of the furnace section of a boiler, at least partially, in the known way, by a wall section formed through liquid or steam tubes placed side by side, the which wall section can surround the entire furnace section, while the convection section has at least one liquid or steam chamber with said liquid or steam tubes, through the which chamber there run flue gas tubes connected with said furnace section, preferably through special flue gas chambers, and being sealed off from the liquid or steam chamber.

Said wall section is formed preferably by essentially vertical, parallel liquid or steam tubes located between at least one upper and at least one lower collecting box for the heat-absorbing medium in liquid or steam form. Said vertical tubes may form either a cylindrical surface or a parallelepipedal surface. The liquid or steam chamber in the convection section, on the other hand, is bounded by a parallelepipedal or cylindrical, continuous liquid or steam chamber formed by plane or curved walls and adjoining at the top and bottom at least one upper and at least one lower flue gas chamber, at least one of which communicates directly with the furnace compartment, the upper and lower flue gas chambers being connected together by vertical flue gas tubes running through the liquid or steam chamber of the convection section.

According to an especially advantageous characteristic of the invention the furnace section and the convection section are made as separate, single production units having preferentially plane connecting surface fitting one another and designed to be secured together by means of flanges or welding.

This provides a boiler the furnace of which has a form which best adapts it to this part of the boiler that is exposed to heavy thermal stresses, while the convection section has a construction that is adequate for the lower working temperatures in question, that is simple and cheap to manufacture and is easily accessible for overhaul and sweeping.

Since the two units are constructed on different principles, they can be manufactured at different places and thereafter be simply fitted together, possibly on the site of assembly or use. This allows rational manufacture and simplified handling, transport and installation.

The invention will now be described with reference to the attached drawings, of which FIG. 1 shows an embodiment of the invention with the furnace section divided into two compartments and the convection section consisting of a liquid-or steam-cooled chamber through which vertical flue gas tubes run, FIG. 2 the embodiment in FIG. 1 in perspective, FIG. 3 an embodiment with the furnace formed for oil-or gas-firing, and FIG. 4 an embodiment which can be fired either with oil or gas from a top-mounted unit or with shavings, chips, coal or bark via a stoker under the boiler.

Figure 2:
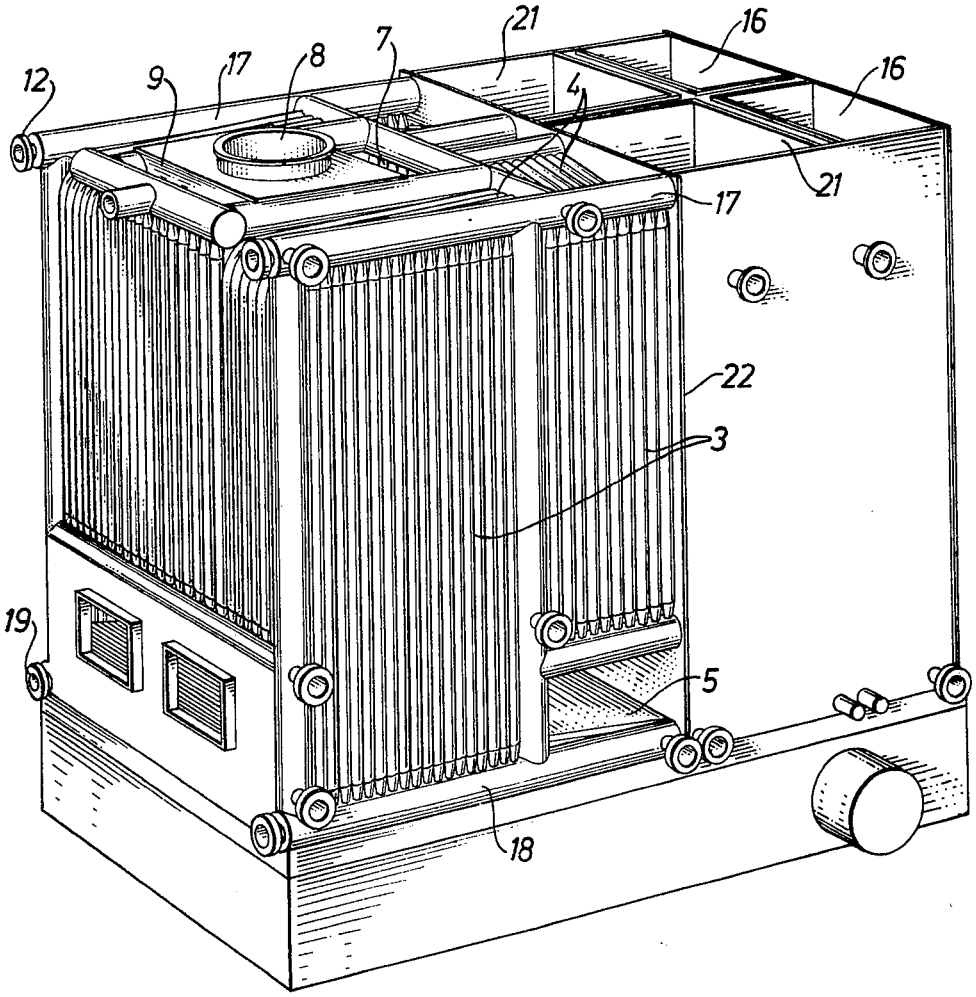

As appears from FIGS. 1 and 2, the boiler according to this embodiment has its section that is most exposed to thermal stresses, i.e. the furnace 1, formed as a water tube section with walls formed by liquid or steam tubes 3 which form side-walls, tubes 4 which form ceiling section and tubes 5 which form floor sections. These tubes 3, 4 and 5 are flowed through by liquid or steam and at both ends are joined in a manner that provides a liquid seal, e.g. by welding, to collecting boxes 17, 18 for the heatabsorbing medium in liquid or steam form.

The convection section 2 is formed by plane or cylindrical walls which enclose a liquid or steam chamber 19 (FIG. 1), through which pass flue gas tubes 6 communicating with the furnace section 1 via the flue gas chamber 16 and 21 and sealed off from the liquid or steam chamber 19.

The tubes 6, which communicate with the flue gas chambers 16, 21, form two or more groups of tubes emerging at the bottom into a common flue gas chamber 20. By leading the flue gases from the flue gas chamber 21 down through the group of flue gas tubes on the left in FIG. 1 to the flue gas chamber 20 and up through the group of flue gas tubes on the right in FIG. 1 to the flue gas chamber 16 and then out to the chimney, the path of the flue gases can be prolonged and a repeated transfer can be obtained to the heat-bearing medium in the liquid or steam chamber 19.

The hot water or steam boiler shown can be fired with liquid, gaseous and/or solid fuel. For oil or gas firing the firing unit can be mounted in the ceiling opening 8 of the boiler. The furnace then constitutes a flame chamber. The described boiler, however, permits quick change-over to domestic fuels in the event of a blockade of imported fuels. The furnace 1 then serves as fuel magazine for wood or coal. Stoking is done in such case through the top hatch 9; and the bottom of the furnace, consisting of water tubes 5, can serve as fire grate section either directly or through supplementation with other equipment.

Figure 3:
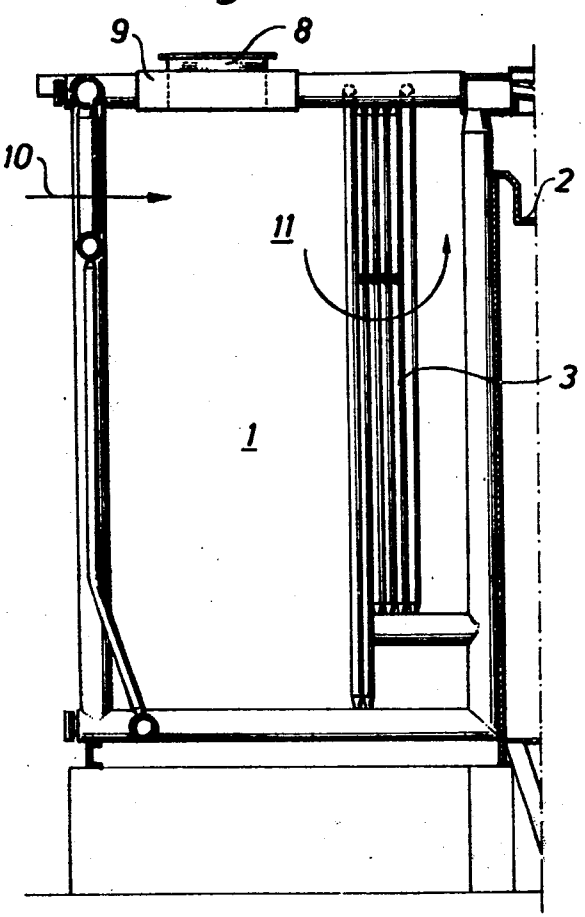

FIG. 3 shows another embodiment of the invention in which the furnace 1 is designed for oil or gas firing via a firing unit conceived to be mounted on the ceiling opening 8. The furnace has in this case also an inlet 10 which can be connected to a preheater for shavings, chips or bark mounted in front of the boiler, whereby the furnace 1 actually forms an after-burning chamber. Through a screen 11 formed of liquid tubes 3 and extending right across the furnace the gases can be led down through the furnace past the screen 11 and up to the flue gas outlet which emerges in the upper flue gas chamber 21 of the subsequent convection section 2. Only a small part of the convection section 2 is shown in the figure. The remainder is imagined cut away through the dot-dash line.

The bottom of the furnace 1 can be made liquid-cooled unless it is desired to leave it open in order to separate out the residue downwards and thereafter return it to the preheater through some suitable device not shown in the drawing.

Figure 4:
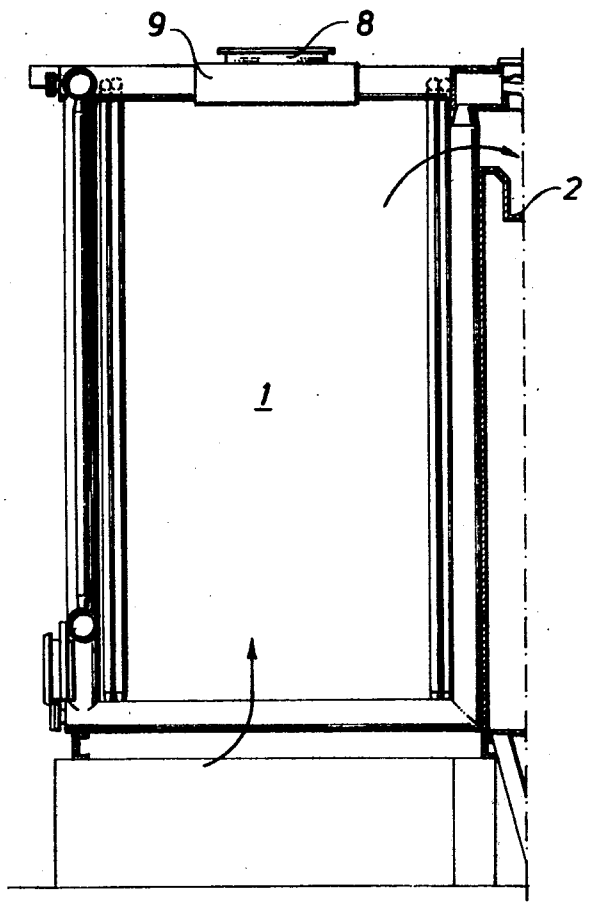

FIG. 4 shows still another embodiment of the boiler according to the invention, also intended for oil- or gasfiring via a unit mounted on the ceiling opening 8. This boiler can also be fired with shavings, chips or bark via a stoker, not shown in the drawing, for supplying the fuel to the furnace from below. Alternatively a preheater could be connected from below, being used in such case roughly like the preheater for the boiler described in conjunction with the embodiment in FIG. 3.

The drawings show parallelepipedal forms of embodiment of the invention, but the boiler could also be made cylindrical.

As appears from FIG. 1, the outlet 12 from the boiler is connected to a user's riser pipe, while the inlet 13 to the boiler, coming from the user's return pipe, can suitably be connected to the convection section. In the attempt to avoid corrosion of the tubes on return of the return fluid to the convection section, it is advisable to introduce diverting shoulders or walls 14 or 15 which carry the water down into the liquid or steam chamber 19 in order as a means of preventing corrosion, to avoid immediate contact between the incoming flow of liquid or steam with the flue gas tubes 6 and to ensure effective mixing of incoming return water.

Although the invention has been described with reference to some of its embodiments, it may nevertheless be arbitrarily varied within the scope of the subsequent claims.

What is claimed is:

1. A boiler for steam or hot water comprising:

a furnace section having a chamber defined substantially in its entirety by top, bottom and sidewalls formed of closely arranged horizontally and vertically extending liquid or steam tubes respectively, said tubes thus being exposed to combustion radiation and flue gases within said chamber;

a convection section positioned horizontally of said furnace section including at least one chamber for liquid or steam;

connecting means for oeratively connecting said furnace and convection sections to permit the flow of liquid or steam between said tubes and said chamber;

means for conducting flue gases from said furnace chamber to said convection section;

and a plurality of flue gas tubes within said convection section arranged therewithin to conduct flue gases from said furnace chamber in a substantially U-shaped path through the liquid or steam chamber for heat exchange with the liquid or steam therewithin.

2. A boiler according to claim 1, wherein said furnace and convection sections are fabricated as separate units and are assembled in side-by-side positional relationship to thereby form said boiler.

3. A boiler according to claim 2, including complementary connecting surfaces on said furnace and convection sections to facilitate assembly thereof.

4. A boiler according to claim 3, wherein said complementary surfaces are planar.

5. A boiler according to claim 1, including an opening in the sidewall of said furnace permitting discharge of flue gases from the furnace chamber.

6. A boiler according to claim 1, including return pipe means for recycling liquid or steam to said convection section and baffle members within said convection section for diverting recycled liquid or steam downwardly therewithin into the chamber for liquid or steam and preventing impingement on said flue gas tubes.

7. A boiler according to claim 1, including at least one flue gas chamber in the upper portion of said convection section, said flue gas tubes extending from said flue gas chamber and through said chamber for liquid or steam.

8. A boiler according to claim 7, including a second flue gas chamber below said chamber for liquid or steam, a first group of flue gas tubes connecting said first and said second flue gas chambers, and a second plurality of flue gas tubes connecting said second flue gas chamber with a discharge opening in said convection section for discharge of the flue gases to a chimney.

* * * * *